United States Patent [19]

Koba

[11] Patent Number: 4,691,629

[45] Date of Patent: Sep. 8, 1987

[54] APPARATUS FOR DEHYDRATING CRUDE VENEER

[75] Inventor: Yoshinori Koba, Kajitacho Ohbushi, Japan

[73] Assignee: Meinan Machinery Works, Inc., Kajitacho Ohbushi, Japan

[21] Appl. No.: 791,359

[22] Filed: Oct. 25, 1985

[30] Foreign Application Priority Data

Oct. 30, 1984 [JP] Japan ..... 59-229691

[51] Int. Cl.[4] ..... B30B 9/20

[52] U.S. Cl. ..... 100/121; 100/176; 29/121.6; 144/362

[58] Field of Search ..... 100/98 R, 121, 176, 100/902; 29/121.6, 121.7; 144/362, 254, 255, 280

[56] References Cited

U.S. PATENT DOCUMENTS

| | | | |
|---|---|---|---|
| 128,387 | 6/1872 | Gyles | 144/362 |
| 1,369,335 | 2/1921 | Goodfellow | 100/121 |
| 1,384,103 | 7/1921 | Smith | 100/902 |
| 1,517,036 | 11/1924 | Wagner | 29/121.6 |
| 1,908,519 | 5/1933 | Leonard | 100/121 X |
| 3,431,616 | 3/1969 | Lewis | 29/121.6 |

FOREIGN PATENT DOCUMENTS

| | | |
|---|---|---|
| 48-49905 | 7/1973 | Japan . |
| 52-9721 | 3/1977 | Japan . |
| 56-32547 | 7/1981 | Japan . |

*Primary Examiner*—Peter Feldman

*Attorney, Agent, or Firm*—Lahive & Cockfield

[57] ABSTRACT

An apparatus for dehydrating a crude veneer includes a pair of spaced parallel rolls each being provided with teeth on the periphery thereof which become sequentially aligned with those of the other roll as the rolls are rotated in opposite directions to each other. A veneer is passed through the gap between the rolls to efficiently squeeze out water while being subjected to a minimum of plastic deformation. This is accomplished by optimumly selecting the distance between the tips of the teeth on the two rolls as well as the distance between the peripheries of the rolls except for the teeth. The periphery of each roll is covered with an elastic material such as sponge in order to prevent water once pressed out from the veneer by the teeth from permeating into the veneer again.

20 Claims, 11 Drawing Figures

APPARATUS FOR DEHYDRATING CRUDE VENEER

BACKGROUND OF THE INVENTION

The present invention relates to an apparatus for mechanically removing water which is contained in the tissues, mainly tracheae and tracheids, of crude veneers which are relatively watery.

A crude veneer generally has a water content ranging from 30–200 percent and needs some treatment for dehydration to serve as a ply, for example. One implementation available for dehydration of crude veneers is mechanical drying which squeezes out water by compression, as proposed in Japanese Unexamined Patent Publication (Kokai) No. 48-49905 and others. A prior art apparatus for mechanical drying uses pressing elements such as so-called dry rolls which are each provided with tooth-like projections on its peripheral surface and pressed against the whole surfaces of a veneer to squeeze out water.

The problem with the prior art apparatus discussed above is that since the distance between the peripheries of the dry rolls except for the teeth, or bottom lands, is not greater than about 30–60 percent of the thickness of a veneer, the rolls cause a veneer to undergo plastic deformation over the entire surfaces against which the rolls are abutted, thereby noticeably reducing the thickness of the veneer. In addition, the prior art apparatus is unsuitable for use with knotty veneers because it would break and remove knots due to the plastic deformation during the course of dehydration.

SUMMARY OF THE INVENTION

It is therefore an object of the present invention to provide an apparatus for dehydrating a crude veneer which removes almost all the water from a crude veneer while causing a minimum plastic deformation in the veneer.

It is another object of the present invention to provide an apparatus for dehydrating a crude veneer which processes even a veneer with nots without breaking or removing the nots.

It is another object of the present invention to provide a generally improved apparatus for dehydrating a crude veneer.

An apparatus for dehydrating a crude veneer of the present invention includes a pair of parallel rolls positioned to face each other. The veneer is fed toward a predetermined position which is defined between the rolls and coplanar with axes of the rolls in such an orientation that fibers of the veneer extend generally in a longitudinal direction of the veneer with respect to an intended direction of veneer feed. A tooth or teeth are provided on the periphery of each of the rolls such that the teeth on the rolls become aligned with each other at the predetermined position between the rolls. The tips of the teeth on the rolls are spaced from each other at the predetermined position by a distance which is substantially 20–60 percent of the thickness of the veneer. The peripheries of the rolls except for the teeth are spaced from each other at the predetermined position by a distance which is at least 90 percent of the thickness of the veneer. A drive mechanism is provided for causing the rolls to rotate in opposite directions to each other.

In accordance with the present invention, an apparatus for dehydrating a crude veneer includes a pair of spaced parallel rolls each being provided with teeth on the periphery thereof which become sequentially aligned with those of the other roll as the rolls are rotated in opposite directions to each other. A veneer is passed through the gap between the rolls to efficiently squeeze out water while being subjected to a minimum of plastic deformation. This is accomplished by optimumly selecting the distance between the tips of the teeth on the rolls and the distance between the peripheries of the rolls for the teeth. The periphery of each roll is covered with an elastic material such as sponge in order to prevent water once pressed out from the veneer by the teeth from penetrating into the veneer again.

The above and other objects, features and advantages of the present invention will become more apparent from the following detailed description taken with the accompanying drawings.

DESCRIPTION OF THE PREFERRED EMBODIMENTS

While the apparatus for dehydrating a crude veneer of the present invention is susceptible of numerous physical embodiments, depending upon the environment and requirements of use, substantial numbers of the herein shown and described embodiments have been made, tested and used, and all have performed in an eminently satisfactory manner.

Briefly, the present invention is derived from the findings that when a crude veneer is inserted to between a pair of rolls in the direction of extension of its fibers, water in the veneer is sequentially pressed out moving within and along tubular tissues such as tracheae and tracheids of the veneer, and that whether the line along which the compression occurs may be continuous or discontinuous such a phenomenon occurs with substantially the same efficiency to remove substantially the same amount of water.

Figure 1:
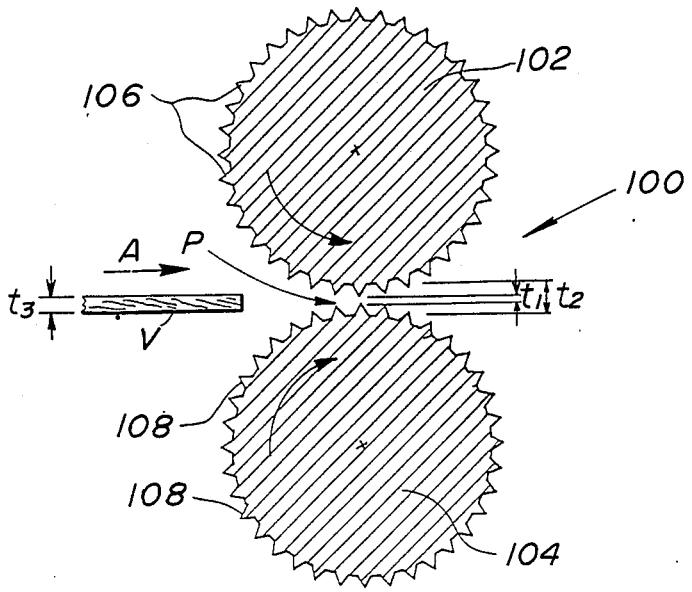
FIG. 1 is a section schematically showing an apparatus for dehydrating a crude veneer embodying the present invention.
Figure 2:
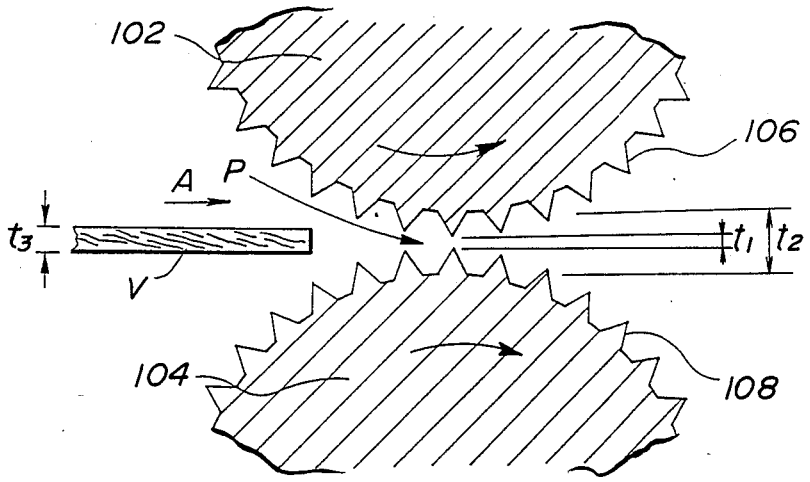
FIG. 2 is a fragmentary section representative of a condition of the apparatus of FIG. 1 before the insertion of a veneer.
Figure 3:
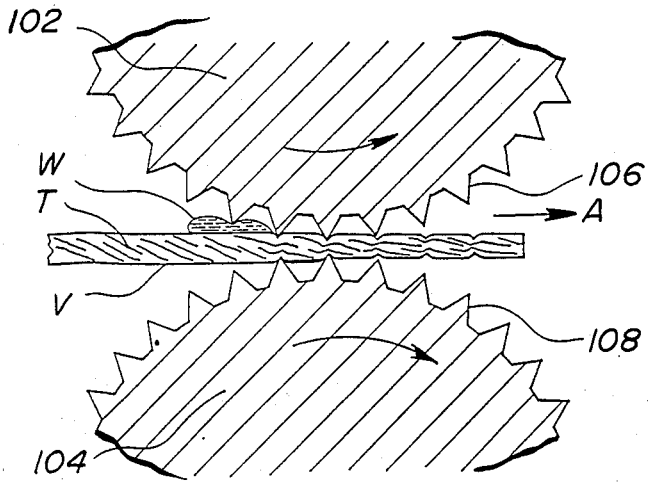
FIG. 3 is a view similar to FIG. 2 but showing a condition after the insertion of a veneer.

Referring to FIGS. 1–3 of the drawings, a dehydration apparatus embodying the present invention is schematically shown and generally designated by the reference numeral 100. The apparatus 100 comprises a pair of parallel rolls 102 and 104 which are located to face each other and rotatable in opposite directions to each other as indicated by arrows driven by a motor or like drive source, not shown. The roll 102 is provided with tooth-like projections 106 on its periphery and the rolls 104 with tooth-like projections 108. As a crude veneer V is inserted to between the rolls 102 and 104, it is fed by the rolls 102 and 104 as indicated by an arrow A.

Each of the teeth 106 and 108 extends either continuously or discontinuously from one end to the other end of its associated roll 102 or 104 across the direction A of veneer insertion. Observing each of the rolls 102 and 104 in a section, the teeth 106 or 108 are positioned at equally spaced locations along the circumference of the roll. The teeth 106 on the roll 102 and the teeth 108 on the roll 104 usually are disposed symmetrically to each other with respect to a plane along which the veneer V is inserted to between the rolls 102 and 104, so that they may become sequentially aligned at a predetermined position P which is defined between the rolls 102 and 104 and coplanar with the axes of the latter. Assuming that the distance between the tips of the upper and lower teeth 106 and 108 at the position P is $t_1$ and the distance between the peripheral surface, or bottom lands, of the upper and lower rolls 102 and 104 is $t_2$, the distance $t_1$ is selected to be 20–60 percent of the thickness $t_3$ of the veneer V and the distance $t_2$, at least 90 percent of the same.

In operation, the veneer V is inserted toward the position P between the rolls 102 and 104 in such an orientation that its fibers generally extend longitudinally of the veneer V with respect to the direction A, as shown in FIG. 2. Then, the rolls 102 and 104 which are rotating in opposite directions to each other drive the veneer V so that the latter is locally subjected to compressive deformation at its both surfaces, as shown in FIG. 3. As a result, tracheae, tracheids and other tubulous tissues T of the veneer V each extending in the direction A are deformed at those portions of the veneer V against which the teeth 106 and 108 are abutted as well as before and after those portions. This forces water in the tissues T toward the inlet side and outside side, with respect to the direction A, away from the position P. Then, the bottom land between the nearby teeth 106 and that between the nearby teeth 108 slightly compress the veneer V from opposite sides. Here, it is to be noted that the contact of the bottom lands with the veneer V may not occur when the previously mentioned distance $t_2$ is greater than the distance $t_3$. Thereafter, the teeth 106 and 108 next to those teeth which have compressed the veneer V cause the veneer V to undergo local compressive deformation at opposite surfaces. The distance between the nearby teeth 106 and that between the nearby teeth 108 are selected to be short enough for the water forced by the preceding teeth 106 and 108 toward the inlet side with respect to the position P to be forced further toward the inlet side by the following teeth 106 and 108. Such a procedure is repeated with the result that the water is sequentially pressed toward the inlet side along the tissues T of the veneer V.

From the probability standpoint, it is rare that the tubulous tissues T of the veneer V extend exactly parallel to the opposite major surfaces of the veneer P; usually their opposite ends are open to the outside at both veneer surfaces. Consequently, the water moved as discussed above along the tissues T is squeezed out at the opposite veneer surfaces. Such an occurrence also applies to that part of the water which is forced by the teeth 106 and 108 toward the outlet side with respect to the position P. At either side of the position P, the water pressed out to the lower surface of the veneer V is let fall by gravity, while the water W pressed out to the upper surface collects at the inlet side adjacent to the roll 102 to be let fall by gravity at both sides and trailing end of the veneer V. For further effective removal of the water W on the veneer upon surface, use may be made of a forcible implementation such as blowing compressed air or suction by vacuum.

Since the veneer is compressed by and only by the teeth 106 and 108 during the above-described dehydration up to the range of plasticity or breakage, it is plastically deformed or broken only at those limited spots which are effected by the teeth 106 and 108, plus some narrow inlet and outlet regions adjacent thereto. Stated another way, the thickness of the veneer V as a whole is little reduced because a major part of the veneer V against which the bottom lands of the rolls 102 and 104 abut undergoes deformation within the range of elasticity only. Such a veneer V is comparable in width and strength with a veneer which is processed by the ordinary evaporation drying technique, when subjected to heat and compression as may occur later at a bonding stage.

The local compressive deformation offers another advantage that a veneer with knots can be dehydrated without having the knots removed, thereby effectively eliminating various troubles due to removal of knots. The device 100, therefore, is capable of desirably coping even with knotty timber.

Generally, the tubulous tissues T of a veneer V are inclined relative to the surfaces of the veneer V and release water by an amount which differs from the upper surface of the lower surface. For more effective dehydration, therefore, the veneer V may be passed through the rollers 102 and 104 twice or more while being turned over each time. The insertion of the veneer V to between the rollers 102 and 104 may be effected either manually or automatically as desired. In addition, the distance between the bottom lands of the rolls 102 and 104 in practice may be designed relatively short such that the the veneer V undergoes some insignificant degree of plastic deformation.

Figure 4:
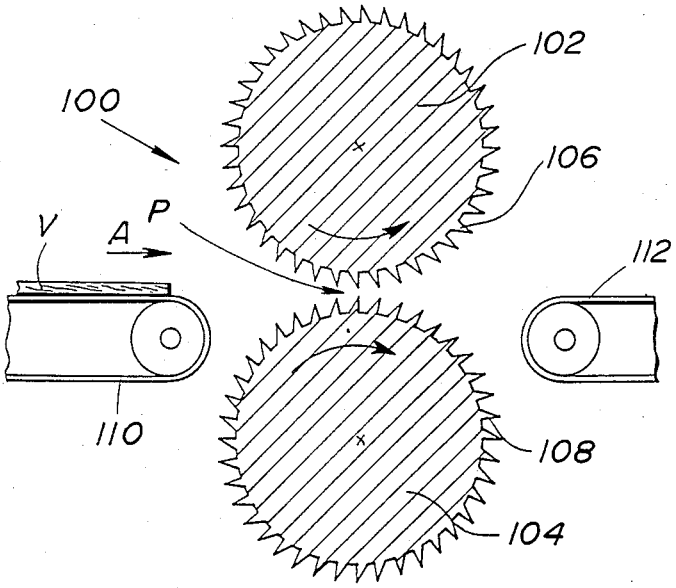
FIG. 4 is a front view of a specific construction of the apparatus shown in FIGS. 1–3.
Figure 5:
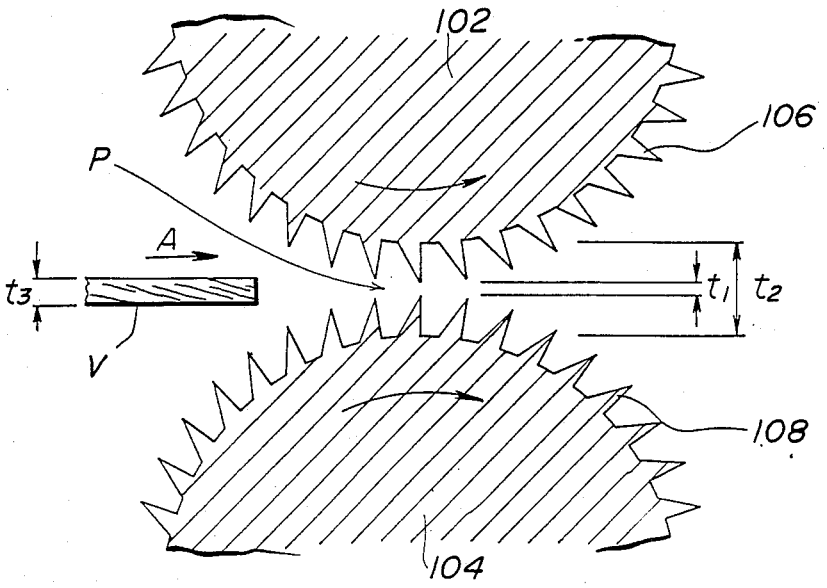
FIG. 5 is an enlarged view of the apparatus shown in FIG. 4.

Referring to FIGS. 4 and 5, a specific construction of the apparatus 100 discussed hereinabove is shown. In this particular construction, each of the rolls 102 and 104 is made of metal and provided with a diameter of 75 millimeters and a length of 300 millimeters. Each of the teeth 106 and 108 on the rolls 102 and 104 extends continuously from one end to the other end of the associated roll and parallel to the axis of the roll. The teeth 106 on the roll 102 and the teeth 108 on the roll 104 are each positioned at the pitches of about 5 millimeters along the circumference of the associated roll. In a section perpendicular to the axis of the roll 102 (or 104), each of the teeth 106 (or 108) is shaped in a right-angled triangle having an apex angle $\theta$ of 30 degrees and a height of 5 millimeters. Further, the distance $t_1$ between the tips of the teeth 106 and 108 of the upper and lower rolls is selected to be 40 percent of the thickness $t_3$ of the veneer V; in this particular example, the thickness $t_3$ is 3.2 millimeters and, therefore, the distance $t_1$ is 1.3 millimeters.

Figure 6:
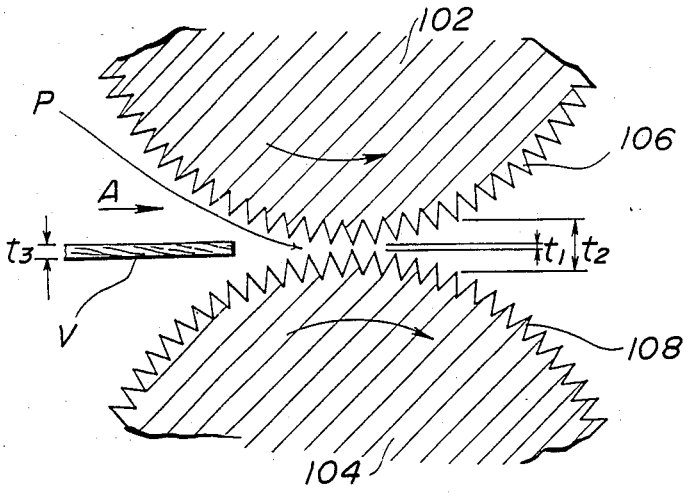
FIG. 6 is a fragmentary view similar to FIG. 5 but showing another specific construction of the apparatus shown in FIGS. 1–3.

Referring to FIG. 6, another example of the rolls 102 and 104 in accordance with the illustrative embodiment is shown. Each of the rolls 102 and 104 in this example is made of metal and dimensioned 140 millimeters in diameter and 300 millimeters in length. The teeth 106 and 108 on the rolls are each provided with an isosceles triangular cross-section having an apex angle of 45 degrees and a height of 6.1 millimeters. In this particular example, the teeth 106 and 108 are arranged each in a contiguous gear-like configuration and at the pitches of 5 millimeters along the circumference of the roll 102 or 104.

In any of the configurations described above, at least one of the rolls 102 and 104 is operatively connected to a drive source through a gearing, both not shown, such that the teeth 106 and 108 are rotatable in opposite directions to each other while being sequentially aligned with each other at the particular position P between the rolls 102 and 104. As shown in FIG. 4, a conveyor 110 is located at the inlet side of the rolls 102 and 104 in order to feed the veneer V toward the position P in the direction A maintaining It in the previously mentioned orientation. Another conveyor 112 is located at the outlet side of the rolls 102 and 104 for transporting the veneer V which comes out of the rolls 102 and 104 toward a predetermined station.

The apparatus 100 in accordance with the illustrative embodiment was used to dehydrate larch veneers each being 3.2 millimeters thick and found to successfully reduce an average water content which was 145 percent to 80 percent.

Figure 7:
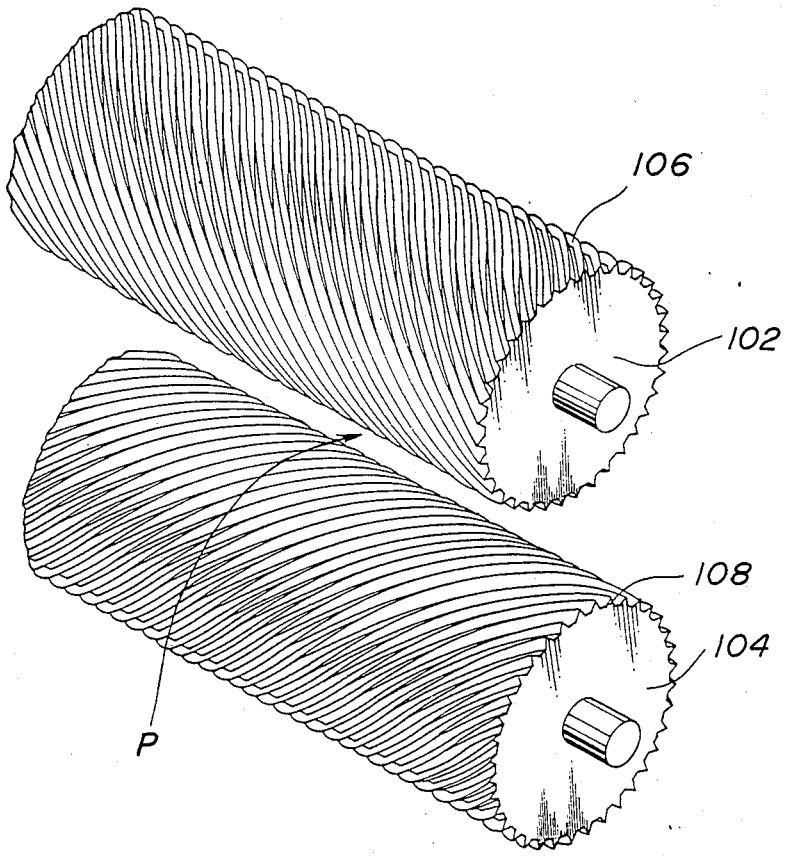
FIG. 7 is a perspecive view of another example of rolls which are included in the apparatus of FIGS. 1–3.

Referring to FIG. 7, still another specific configuration of the rolls 102 and 104 which are included in the apparatus 100 is shown. In this particular example, the teeth 106 and 108 extend spirally along their associated rolls 102 and 104 at an angle of inclination not greater than 45 degrees to the roll axis. The teeth 106 and 108 are spaced equal distances from each other on their associated rolls 102 and 104, e.g. 4 millimeters. Since the prerequisite in accordance with the present invention is that the teeth 106 and 108 on the rolls 102 and 104 be aligned with each other at the position P between the rolls 102 and 104, they are formed symmetrically to each other with respect to the plane of veneer insertion. An advantage particular to such a roll configuration is that the spiral teeth 106 and 108 leave only insignificant traces of compressive deformation, i.e., cuts in stripes, in the surfaces of the veneer V.

It should be noted that the diameter and length of the rolls 102 and 104, the number and configuration of the teeth 106 and 108 and others are not limited to those which are shown and described and may be suitably modified insofar as they meet the principle of the present invention. The teeth 106 and 108 in particular may be formed either continuously over the length of their associated rolls 102 and 104 or discontinuously. Further, they may be formed obliquely, rather than spirally, at a predetermined angle of inclination not greater than 45 degrees to the roll axis. For positive drainage of removed water, the rolls 102 and 104 may be positioned vertically so as to allow the veneer V to be passed therethrough in a vertical or upright position. As regards the distance between the upper and lower rolls 102 and 104 and the distance between the tips of their teeth 106 and 108, any desired values may be selected so long as they satisfy the conditions of the present invention.

Figure 8:
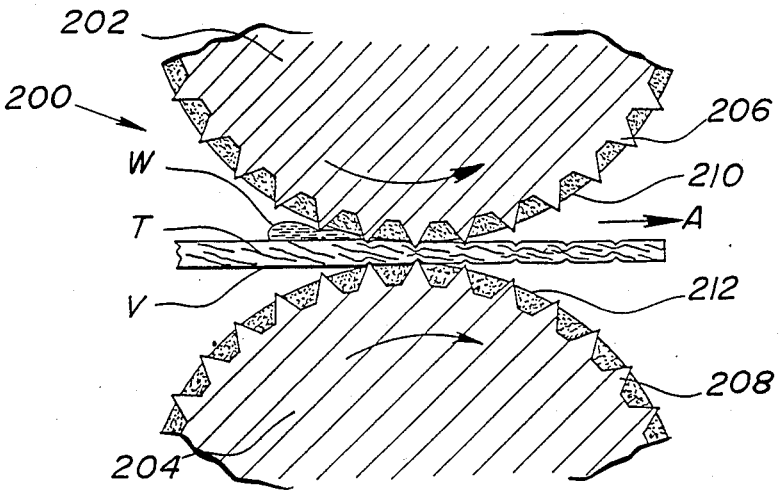
FIG. 8 is schematic section showing another embodiment of the present invention in a dehydrating condition.

Referring to FIG. 8, a dehydration apparatus in accordance with another embodiment of the present invention is schematically shown. The apparatus, generally 200, comprises a pair of rolls 202 and 204 which, like the rolls 102 and 104 of the apparatus 100, are provided with teeth 206 and 208, respectively. In this particular embodiment, the recesses defined between the nearby teeth 206 and those between the nearby teeth 208 are filled with layers of an elastic material 210 and 212, respectively. The elastic material may comprise sponge, for example. In such a construction, the elastic layers 210 and 212 serve to prevent water squeezed out from the veneer V from slipping through the gaps between the teeth at the position P, as will be described in detail.

It should be noted that the specific dimensional ranges of the distance between the tips of the teeth and the distance between the bottom lands of the rolls which have been described in relation to the first embodiment hold true with this second embodiment, too.

The apparatus 200 has an advantage, in addition to those attainable with the apparatus 100, that it moves more of the water which is forced out of the veneer V by compressive deformation toward the inlet and outside sides of the rolls 202 and 204. Especially, although the water W which has collected at the inlet side on the veneer upper surface is likely to move toward the outlet side confined in the recess between the tooth 206 which has acted on the veneer V and the next teeth 206, it is prevented from doing so by the elastic layer 210 which fills that recess and, rather, caused to move toward the inlet side. As a consequent, a greater amount of water collects on the upper surface of the veneer V than in the case without the elastic layer 210. In this manner, the apparatus 200 substantially prevents the water W once pressed out from permeating the veneer V again and, thereby, dehydrates the veneer V more efficiently than the apparatus 100.

Figure 9:
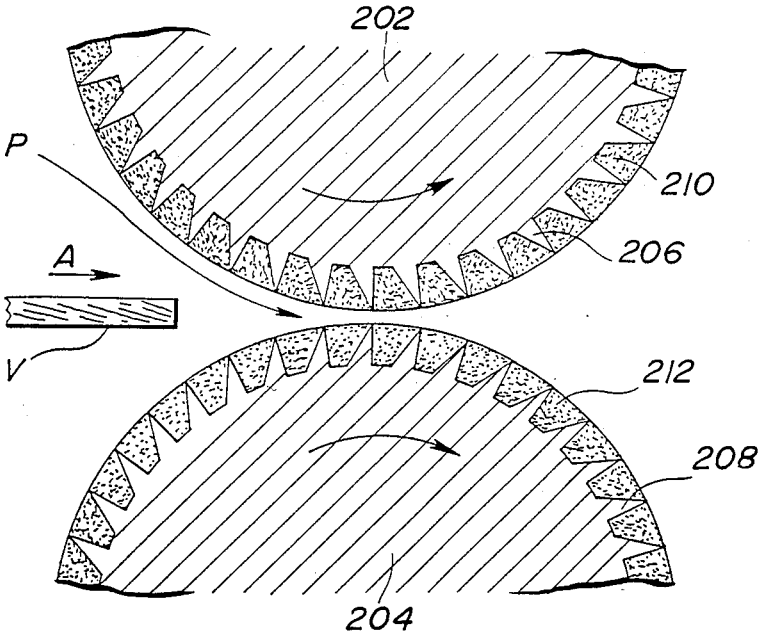
FIG. 9 is a section showing a specific construction of the apparatus of FIG. 8.

Referring to FIG. 9, a specific construction of the apparatus 200 described above is shown in a sectional view. As stated with reference to FIG. 8, the apparatus 200 is characterized in that the recesses between the nearby teeth 206 and those between the nearby teeth 208 respectively are filled with the elastic layers 210 and 212 such as sponge. Hence, the rolls 202 and 206 shown in FIG. 9 are constructed in exactly the same manner as the rolls 102 and 104 shown in FIG. 5, except for the elastic layers 210 and 212 and, for this reason, description of the configurations of the respective structural elements will be omitted. In this particular example, the layers 210 and 212 comprise sponge having a hardness within the range of 60–80 degrees, preferably single-foam sponge, and are cohered by baking to the surfaces of the rolls 202 and 204 as well as to their teeth 206 and 208.

Figure 10:
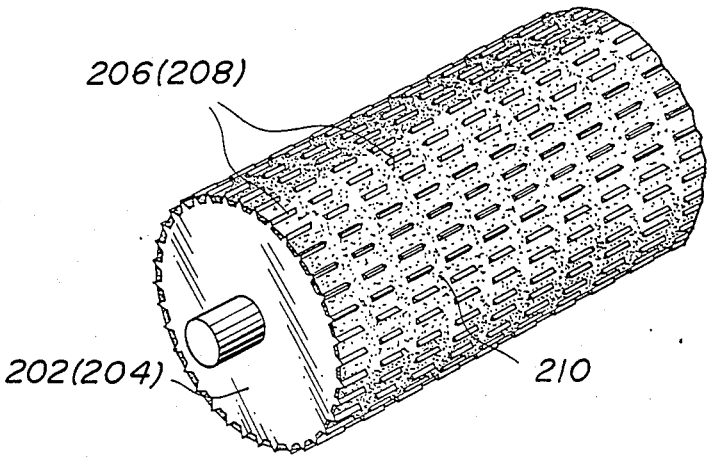
FIGS. 10 and 11 are perspective views of other examples of rolls which are included in the apparatus of FIG. 8.

Referring to FIG. 10, a specific example of the rolls 202 and 204 is shown. As shown, the teeth 206 (208) on the roll 202 (204) are each in the form of a discontinuous array of tooth fragments, or projections, which extends over the length of the roll. Such discontinuous teeth 206 effectively reduce the load which acts on the elastic layer 210 (212). Specifically, despite that a substantial load acts on the elastic layer 210 (212) when it makes contact with the veneer V, the layer 210 (212) is allowed to elastically deform and penetrate into the recesses between the adjacent tooth fragments 206 (208) in the discontinuous array with the result that the load is reduced. This effectively safeguards the surface of the layer 210 (212) against damage and the whole layer 210

(212) against separation from the associated roll 202 (204).

Figure 11:
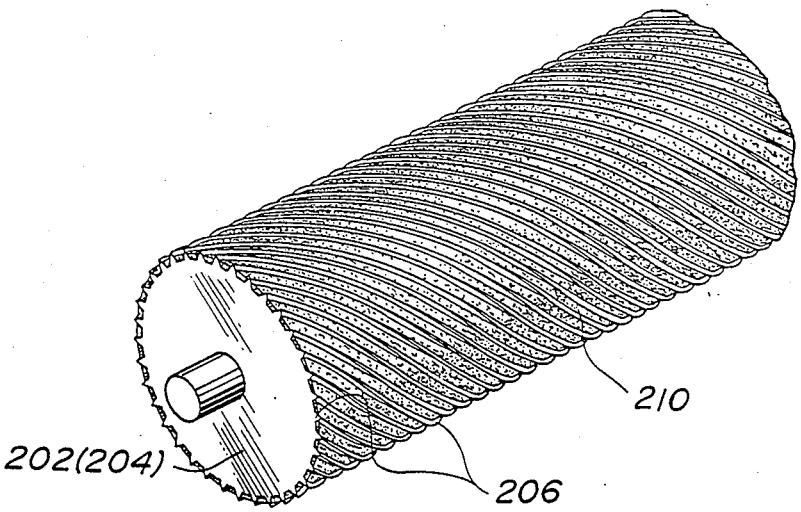

Another specific example of the roll 202 (204) is shown in FIG. 11. The roll 202 (204) in FIG. 11 is constructed by applying the elastic layer 210 (212) to the roll 102 (104) of the kind having spirally or obliquely extending teeth, as shown in FIG. 7. In this case, too, the load acting on the layer 210 (212) will be cut down because the layer 210 (212) is movable obliquely in opposite directions along the teeth 206 (208).

In summary, it will be seen that the present invention provides an apparatus which efficiently removes most of water from a crude veneer while allowing a minimum of plastic deformation to occur in the veneer.

Various modifications will become possible for those skilled in the art after receiving the teachings of the present disclosure without departing from the scope thereof.

What is claimed is:

1. An apparatus for dehydrating a crude veneer, comprising:

a pair of parallel rolls positioned to face each other, the veneer being fed toward a predetermined position which is defined between said rolls and coplanar with axes of said rolls in such an orientation that fibers of the veneer extend generally in a longitudinal direction of the veneer with respect to an intended direction of veneer feed;

tooth means provided on a periphery of each of said rolls such that said tooth means on the rolls become aligned with each other at said predetermined position between the rolls, tips of said tooth means on the rolls being spaced from each other at said predetermined position by a distance which is substantially 20–60 percent of a thickness of the veneer;

the peripheries of the rolls except for said tooth means being spaced from each other at said predetermined position by a distance which is at least 90 percent of the thickness of the veneer; and drive means for causing the rolls to rotate in opposite directions to each other.

2. An apparatus as claimed in claim 1, wherein the tooth means comprises a plurality of teeth which extend parallel to the axis of the roll associated with said tooth means and are located at equally spaced locations along the circumference of the roll.

3. An apparatus as claimed in claim 2, wherein each of said teeth extends continuously without interruption.

4. An apparatus as claimed in claim 2, wherein each of the teeth extends discontinuously with interruptions.

5. An apparatus as claimed in claim 2, wherein each of the teeth is triangular in a section which is perpendicular to the axis of the roll.

6. An apparatus as claimed in claim 1, wherein the tooth means comprises a plurality of teeth which extend parallel to each other and at an angle not greater than 45 degrees to the axis of the roll associated with said tooth means, said teeth being located at equally spaced locations along the circumference of the roll.

7. An apparatus as claimed in claim 6, wherein said teeth extend spirally along the periphery of the roll.

8. An apparatus as claimed in claim 6, wherein each of the teeth is triangular in a section which is perpendicular to the axis of the roll.

9. An apparatus as claimed in claim 1, further comprising a layer of elastic material which covers the periphery of each of the rolls except for the tooth means.

10. An apparatus as claimed in claim 9, wherein said elastic material comprises sponge.

11. An apparatus for dehydrating crude veneer which includes a pair of parallel rolls adapted to be rotated in opposite directions and spaced apart from each other so as to provide a space for receiving a crude veneer therebetween to be dehydrated, said veneer being conveyed in such an orientation that the fibers of the veneer extend substantially along the direction of the conveyance of the veneer, each said roll being provided, on the circumference thereof, with a plurality of tooth means projecting outward to provide ends for pressing against the crude veneer when the veneer has been conveyed into said space, said tooth means being located at certain intervals to provide bottom sections between said tooth means and on the circumference of the roll, such apparatus being characterized in that:

(a) said tooth means of said each roll extends to a tooth peak aligned at certain angles with respect to the direction of rotation of the roll;

(b) said certain intervals covered by said bottom sections on each said roll are the same as those covered by said bottom sections on the other roll, and each said bottom section on each said roll corresponds to a said bottom section on the other roll such that when the rolls are rotated the said bottom sections come in registry to opposing positions so as to define a portion of said space for receiving the crude veneer, and such that each said tooth means of each said roll is in opposed alignment, at said time, with one of said tooth means of the other roll at said tooth peaks thereof for pressing against the veneer; and (c) the peak of each said tooth means of each said roll has a distance when in opposed alignment approximately equal to 20 to 60 percent of the thickness of the crude veneer from the peak of said one of said tooth means of the other roll, while each said bottom section on each said roll is spaced a distance at least equal to 90 percent of the thickness of the crude veneer from the bottom section on the other roll with which it is in registry at said time.

12. An apparatus in accordance with claim 11, wherein said certain angles of said tooth means of each roll are at right angles to a direction of rotation of the roll so that said tooth means of said each roll extend in parallel with a central axis of the roll, and said certain intervals between said tooth means of said each roll are equal to one another.

13. An apparatus in accordance with claim 12, wherein each said tooth means of each said roll is a single continuous length of tooth means.

14. An apparatus in accordance with claim 12, wherein each said tooth means of each roll does not extend continuously, but is separated into more than one length.

15. An apparatus in accordance with claim 12, wherein each said tooth means of each said roll is tapered toward said peak end thereof for pressing against the crude veneer, so that the entire tooth means takes the shape of a triangle in its vertical cross section.

16. An apparatus in accordance with claim 11, wherein said certain angles of said tooth means of each roll do not exceed 45 degrees to the direction of rotation of the roll and said certain intervals between said tooth means of each said roll are equal to one another.

17. An apparatus in accordance with claim 16, wherein each said tooth means of each said roll forms a spiral around the circumference of the roll.

18. An apparatus in accordance with claim 16, wherein each tooth means of each said roll is tapered toward said peak end thereof for pressing against the crude veneer, so that the entire tooth means takes the shape of a triangle in vertical cross section.

19. An apparatus in accordance with claim 11, wherein each said bottom section on each said roll is covered with elastic material.

20. An apparatus in accordance with claim 19, wherein said elastic material is sponge.

* * * * *

UNITED STATES PATENT AND TRADEMARK OFFICE

CERTIFICATE OF CORRECTION

PATENT NO. : 4,691,629

DATED : September 8, 1987

INVENTOR(S) : Yoshinori Koba

It is certified that error appears in the above-identified patent and that said Letters Patent is hereby corrected as shown below:

Column 1, lines 42 and 43, replace "nots" with --knots--.

Column 2, line 10, insert --except-- before "for".

Column 2, line 13, replace "penetrating" by --permeating--.

Column 5, line 22, replace "It" with --it--.

Column 5, line 55, insert --entire-- before "length".

Signed and Sealed this

Twenty-fourth Day of May, 1988

*Attest:*

DONALD J. QUIGG

*Attesting Officer*

*Commissioner of Patents and Trademarks*